US005358430A

United States Patent [19]

Bonvallat et al.

[11] Patent Number: 5,358,430

[45] Date of Patent: Oct. 25, 1994

[54] FEMALE SOCKET OF "MODULAR JACK" TYPE WITH INTEGRATED CONNECTIONS

[75] Inventors: Pierre Bonvallat; Xavier Fasce, both of Cluses, France

[73] Assignee: Pouyet International, Ivry-sur-Seine, France

[21] Appl. No.: 98,881

[22] Filed: Jul. 29, 1993

[30] Foreign Application Priority Data

Jul. 31, 1992 [FR] France ..... 92 09744

[51] Int. Cl.[5] ..... H01R 23/02

[52] U.S. Cl. ..... 439/676; 439/402

[58] Field of Search ..... 439/67, 77, 76, 676, 439/344, 395, 402, 403

[56] References Cited

U.S. PATENT DOCUMENTS 4,865,564 9/1989 Denkmann et al. ..... 439/676
4,969,836 11/1990 Magnier et al. ..... 439/344
4,992,055 2/1991 Brummans et al. ..... 439/676

FOREIGN PATENT DOCUMENTS 3903418 1/1990 Fed. Rep. of Germany ..... 439/676

*Primary Examiner*—David L. Pirlot
*Attorney, Agent, or Firm*—Browdy and Neimark

[57] ABSTRACT

Disclosed is a female socket of "modular jack" type, with integrated connections, wherein the modular jack contacts of the female opening of this socket are taken up at the rear on two series of self-stripping contacts at each of two self-stripping slots instead of one. Connection of a wire at the rear of the socket is effected, without specific tool, by closure of a rotating cover which is associated with these self-stripping contacts.

9 Claims, 5 Drawing Sheets

FEMALE SOCKET OF "MODULAR JACK" TYPE WITH INTEGRATED CONNECTIONS

FIELD OF THE INVENTION

The present invention relates to a female socket, for example but not exclusively, a mural type socket of the "modular jack" type with integrated connections and, for example, intended for telephone- or computer-related applications.

BACKGROUND OF THE INVENTION

The female modular jack sockets with integrated connections which are at present marketed by Applicants for telephone- or computer-related applications, comprise, to the rear of the female modular jack opening proper but integral with the assembly, a small bank for the connection of wires with eight conventional self-stripping contacts. This bank is borne by a small printed circuit which effects the connection between the terminals of this modular jack inlet opening proper and this small connection bank with self-stripping contacts.

These known modular jack sockets present certain drawbacks.

- The presence of the printed circuit between the inlet opening and the connection bank creates an impedance break which, as it is desired to rise in frequency (which is more and more the case at the present time), is penalizing as it is the cause of a poor quality of the transmission.
- The depth of this module is such that it often takes up prohibitive room in the cable troughs.
- It is often necessary to be able to wire a plurality of sockets in parallel, or to close an end socket on adaptation resistors. Double the number of wires normally provided must then be connected at the rear of the socket. With the bank incorporating self-stripping contacts which equips these known sockets, it is then necessary to introduce two wires on each other in each self-stripping slot. In that case, the upper wire risks coming out of the slot accidentally. Furthermore, one is in that case obliged firstly to remove the upper wire in order to act on the lower wire, which constitutes a practical disadvantage.
- The drain contact intended to ensure continuity of earth between the incoming multipair cable and the outgoing multipair cable is effected by introducing the two earth wires, or "drain" wires, in a helical spring which is provided to the rear of the module, under said connection bank. This mode of connection is inconvenient and could be improved from the practical standpoint. In certain cases, it is necessary to adopt a connection device different from the one adopted for the other wires.
- The self-stripping connections which are made on the bank, at the rear of the module, require the use of a specific tool to introduce the wires by force in their respective self-stripping slots.
- The module can only be mounted on a moulded plate specially dimensioned and arranged to that end. For example, it cannot be mounted in a simple metal sheet plate previously cut out accordingly.
- In the case of using such a female socket for computer-related applications, the inlet opening comprises a notch in the right-hand corner. A rotatable key is in that case provided on the plate in order to be able to obstruct this notch in the case of using the socket in telephony. The fact that this key is part of the plate and not of the socket itself is a practical hindrance, due to the lack of flexibility of this solution.

It is an object of the present invention to overcome all these drawbacks.

SUMMARY OF THE INVENTION

To that end, it relates to a female socket of the "modular jack" type, with integrated connections, this socket comprising:

- a hollow insulating body presenting a female opening at the front adapted to receive a complementary male "modular jack" plug, and an opening at the rear;
- a solid insulating piece fitting tightly in this rear opening of this body, and provided with longitudinal notches around almost all of this piece and each receive an elastic conducting arm so as to form towards the front conventional elastic, parallel "modular jack" contacts located, as they must be, at the back of said female opening, these notches widening rearwardly on the upper face of this piece, arriving on the transverse rear face of this piece and serving as guides for free, elastic rear parts of these arms which form contact members and which are associated, by couples of contacts of different lengths, with a short contact, with a couple arriving substantially halfway up this rear face and the other, long, descending much further down;
- and two insulating half-caps which are positioned beneath each other to cover the rear part of the body and which each imprison a number of self-stripping contacts equal to half the number of pins of the modular jack socket, with the result that, when these half-caps are placed in position, the self-stripping contacts of the upper half-cap each rub respectively against one of said "short" contacts, whilst, in the same way, the self-stripping contacts of the lower half-cap then each rub respectively against one of said "long" contacts.

At least certain of these self-stripping contacts are advantageously double contacts provided with two self-stripping slots instead of one, and therefore adapted each to receive two wires side by side.

Each of these half-caps advantageously comprises a cover adapted to close by rotating about a pin, this rotatable cover being shaped so as, whilst it is being rotated for closure, to drive into the self-stripping slots, the wires previously "combed" therein.

Finally, there is advantageously provided on each lateral face of said hollow body a longitudinal groove for passage of the two elastic arms of a conducting staple in the form of a recumbent U, this staple being fitted in these grooves so that a respective drain wire may be pinched therein, from the rear of the socket and on each side of said body.

BRIEF DESCRIPTION OF THE DRAWINGS

The invention will be more readily understood on reading the following description with reference to the accompanying drawings, in which.

Figure 3:
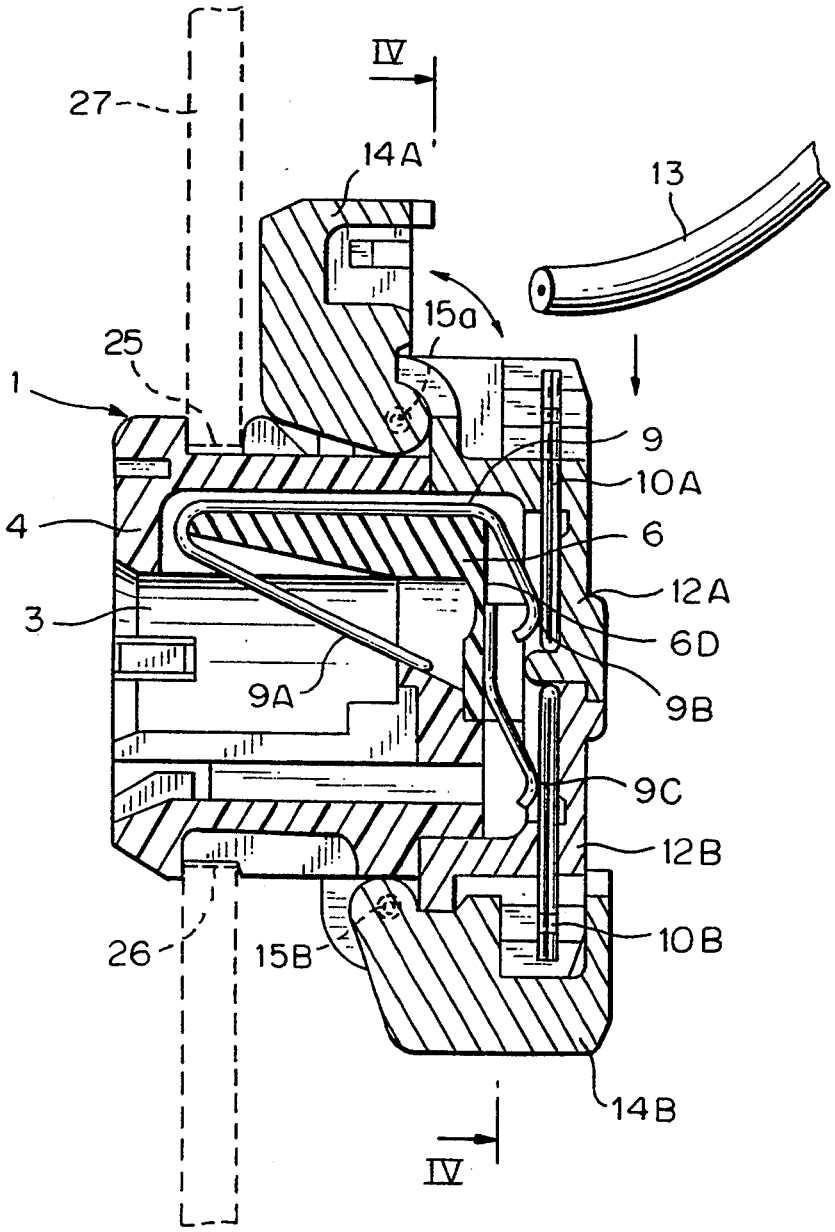
FIG. 3 is a longitudinal section thereof.

FIG. is a view along broken line IV—IV of FIG. 3, with partial section.

Figure 7:
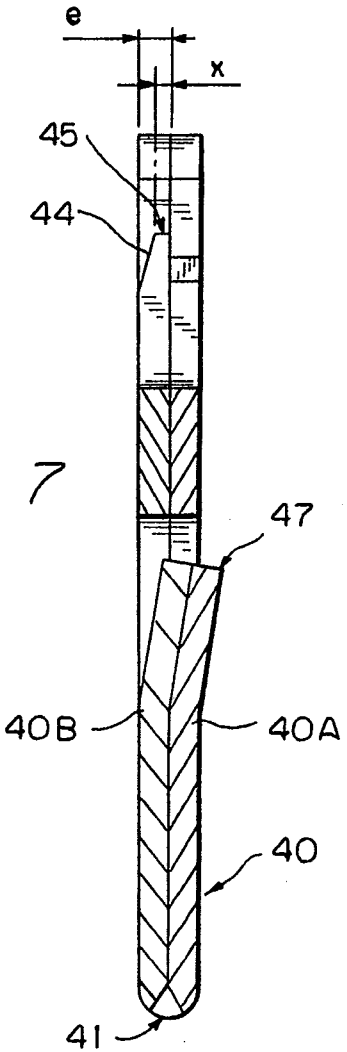
Figure 6:
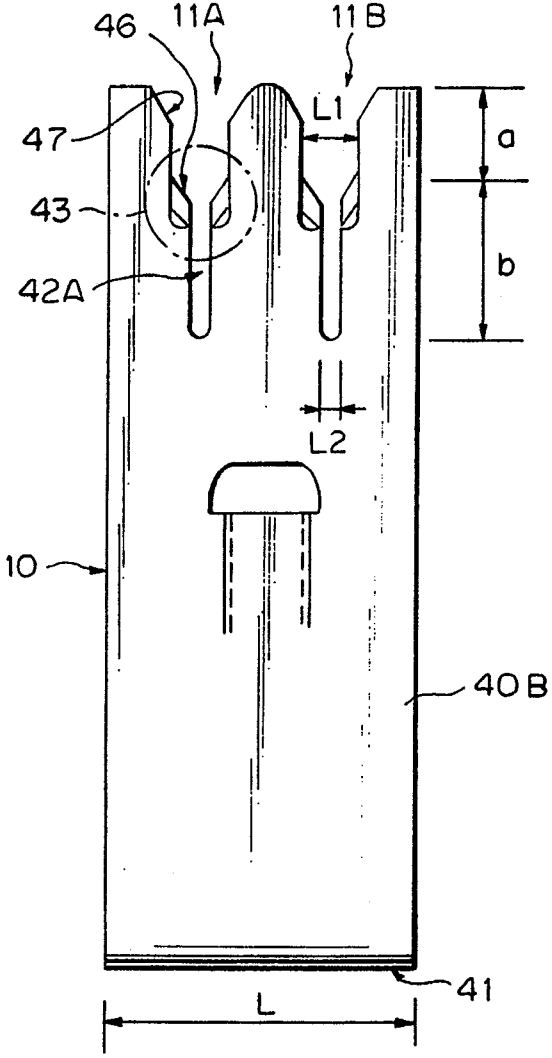
Figure 5:
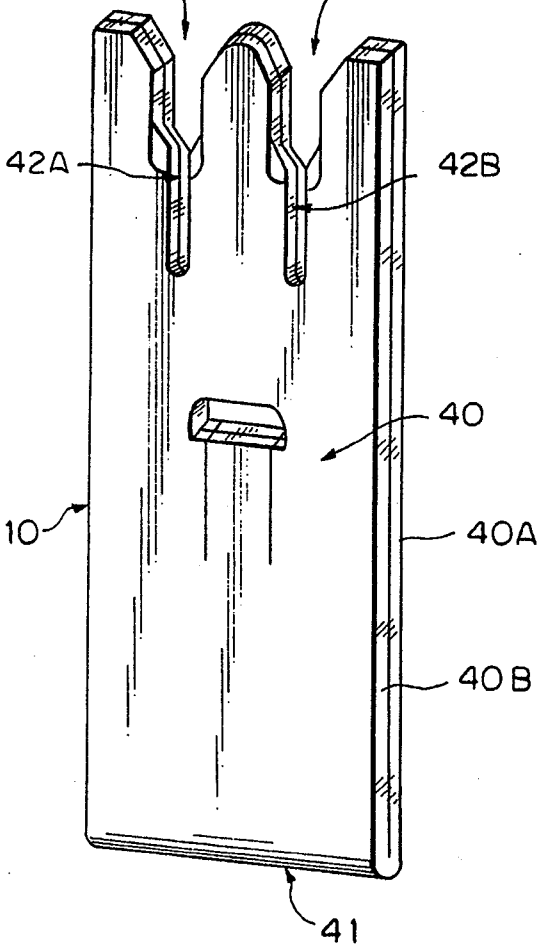

FIGS. 5, 6 and 7 are, respectively, a view in perspective, a plan view and a view in longitudinal axial section of a flat, self-stripping metal contact adapted to equip this female modular jack socket.

DETAILED DESCRIPTION OF THE DRAWINGS

Referring now to the drawings, and firstly to FIGS. 1 to 4, they show a female socket 1 of "modular jack" type which is provided to receive a male plug 2, likewise of modular jack type and comprising in this example an earth screen 23.

This socket 1 comprises a front female opening 3 complementary of the plug 2 and provided to be moulded in a plastic body 4 which is also provided with a rear opening 5 forming a rectangular window placed just above the upper level of the opening 3.

Figure 2:
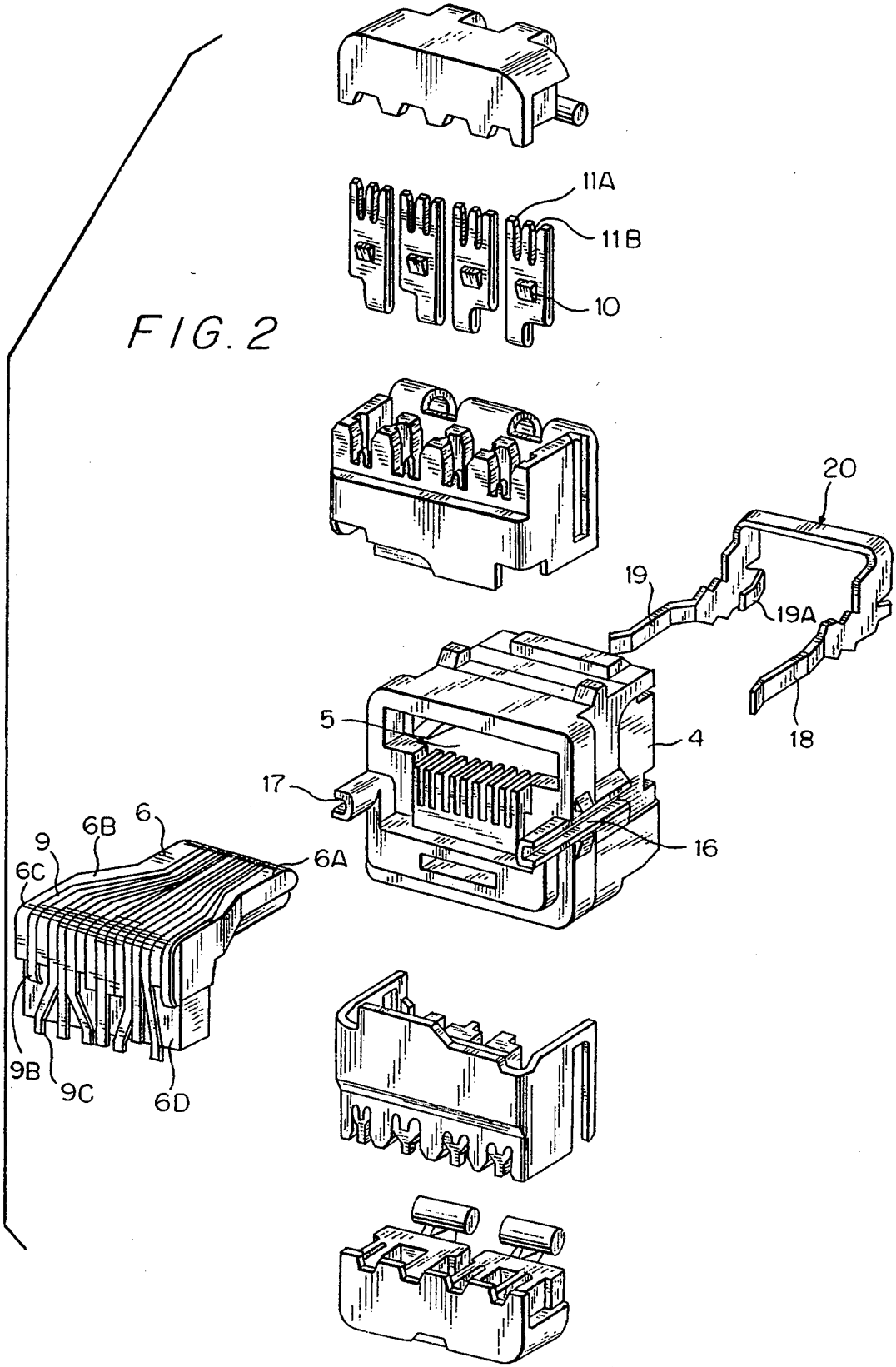
FIG. 2 is an exploded perspective rear view of this same socket.

In this rear window 5 is force-fitted another insulating piece 6 which is solid and provided with eight longitudinal notches 7 around almost all this piece and which each receive an elastic conducting arm 9 (FIGS. 2 and 3).

Figure 1:
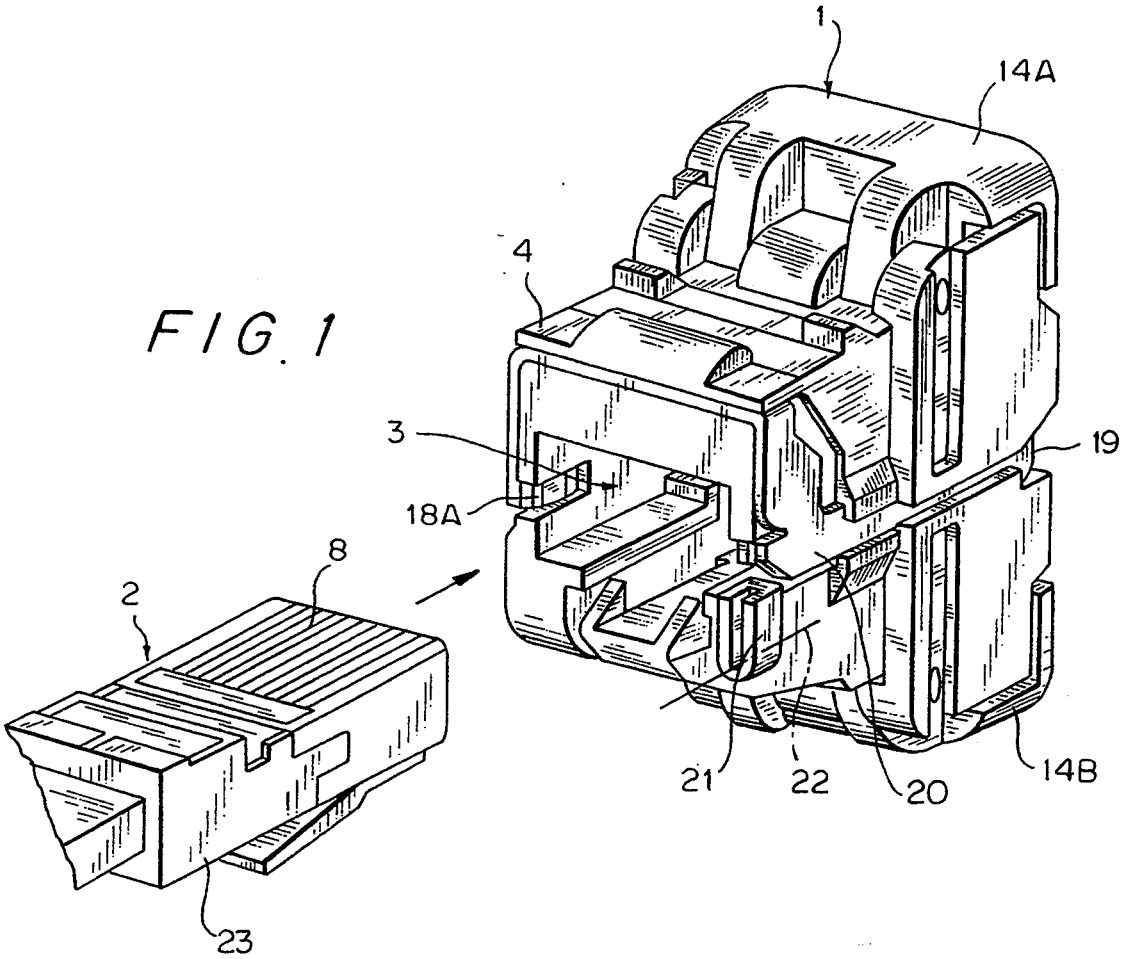
FIG. 1 is a front overall view in perspective of this mural female "modular jack" socket.

In the front part 6A of the piece 6, these notches are parallel and close, and the elastic arms 9 are curved at 9A (FIG. 3) under the piece 6 and inside the opening 3, to form the eight conventional "modular jack" contacts which are complementary of the contacts 8 of the male plug 2 (FIG. 1).

On the median part 6B of the upper face of the piece 6, these notches 7 widen towards the rear in order, on the rear part 6C of this upper face, to be parallel again, but much more spaced apart from one another.

Of course, the elastic arms 9 present the shape corresponding to the notches 7 which receive them respectively, so that they all widen towards the rear, finally bending at right angles against the rear face 6D of the piece 6 and forming an elastic contact which, as shown in FIG. 2, is alternately:

- either a "short" contact 9B which arrives substantially halfway up this rear face 6D;
- or a "long" contact 9C which descends much further down on this rear face 6D.

On this rear face 6D are therefore positioned (FIG. 2) four long elastic contacts 9C and four short elastic contacts 9B, each of them corresponding respectively to one of the eight front contacts 9A mentioned above (FIG. 3).

The short and long supple rear contact arms 9A and 9C respectively, are pressed against a total of eight flat, self-stripping metal contacts 10, each comprising two self-stripping slots 11A and 11B (FIG. 2).

These double self-stripping contacts 10 are arranged in two groups of four superposed contacts:

- a first group of four upper contacts 10A which rub respectively against the "short" elastic contact arms 9B; and
- a second group of four lower contacts 10B which rub respectively against the "long" elastic contact arms 9C.

These two groups each of four self-stripping contacts 10A and 10B respectively are each borne by two respective insulating half-caps which are positioned one under the other to receive the rear part of the hollow body 4:

- an upper half-cap 12A which bears the four upper contacts 10A; and
- a lower half-cap 12B which bears the four lower contacts 10B.

These half-caps do not perform solely the role of fixation and maintenance of these double self-stripping contacts 10A and 10B; they make it possible, in addition, to effect the self-stripping connection of the wires 13 (FIG. 3) to be connected on this socket, without requiring a specific tool as is generally the case. To that end, they are provided with a rotatable cover 14A, 14B which is adapted to close, by rotating about a respective pin 15A, 15B and as indicated by the double arrow in FIG. 3, on the self-stripping slots 11A, 11B of the contacts 10, by driving the sheathed wires 13 previously introduced (i.e. combed) therein. This effect is apparent in FIG. 4 where the cores of the driven wires thus stripped are designated by reference 35. It suffices to use simple multi-grip pliers for this operation.

Figure 4:
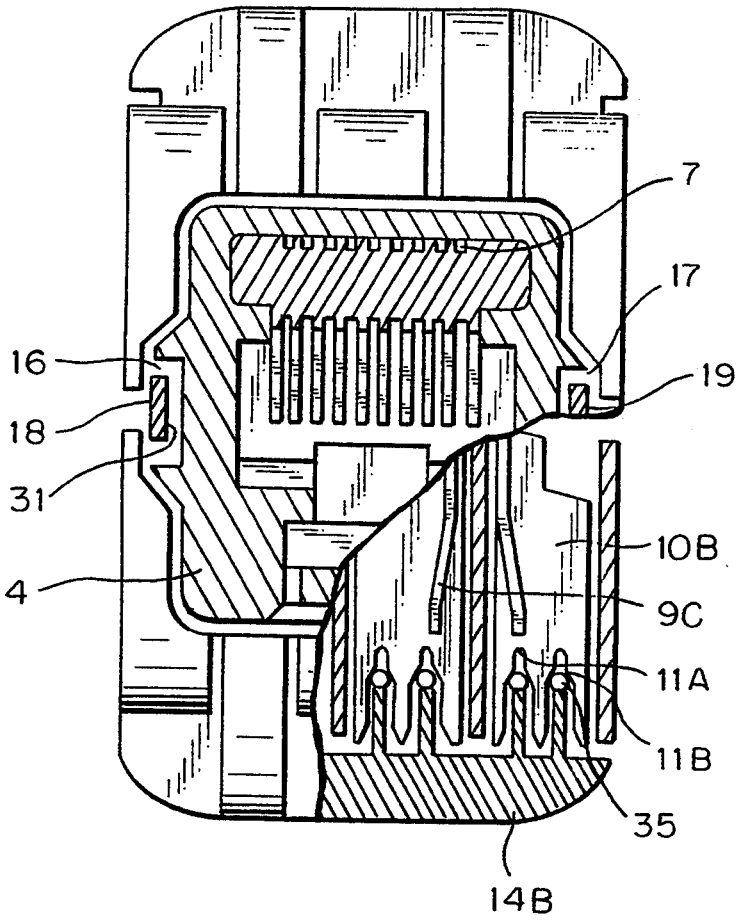

It should be noted that the two half-caps 14A, 14B are both shown closed in this FIG. 4.

The body 4 is, furthermore, provided, on either side, respectively, with two median., lateral and longitudinal grooves 16, 17, which receive the two elastic free arms 18, 19 of a metal staple 20, generally in the form of a recumbent U, which fits via the front of the body 4.

The free ends of these arms are curved at about 170°, at 18A and 19A, inside the opening 3 to ensure electrical contact of earth continuity with the screen 23 of the male plug 2.

The staple 20 serves to ensure screen continuity in cooperation with earth wires or "drain" wires which are to be connected to the rear of the socket 1. It is thus possible to connect two distinct drain wires: for example an inlet wire and an outlet wire. A drain wire 31 (FIG. 4) may be connected on one side of the socket and another on the other side: it suffices to strip, if necessary, the end of the wire and to fit, and therefore pinch, it between one of the arms 18, 19 of the staple 20 and the insulating body 4 (FIG. 4).

Figure 1A:
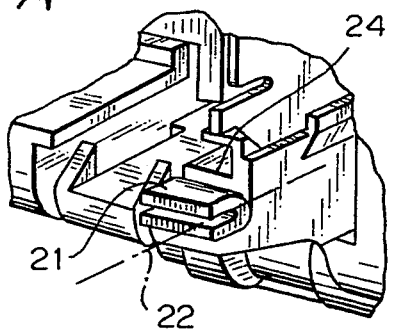
FIG. 1A is a detailed view of this same female socket, but with its key in "computer" position.

Another advantageous characteristic of this modular jack mural socket concerns a key 21 (FIGS. 1 and 1A) which is a small rotatable catch known per se but normally mounted, for the socket of the prior art mentioned above, on the plate receiving this socket. This is not the case here, as this key 21 is mounted to rotate about a pin 22 directly fast with the body 4 of the socket 1.

This key 21 is intended either to leave free (FIG. 1A) or cover (FIG. 1) the small lateral female protuberance 24 which is conventionally provided on the opening 3 in order to be able to differentiate the plugs 2 provided for telephony and in that case not comprising a complementary male protuberance, and those provided for computer-related applications which specifically comprise such a lateral male protuberance. Concerning the opening 3 of the socket 1, passage from one first configuration (FIG. 1) to the other is effected by rotating the key 21 through a quarter turn about its axis 22. The fact that, in this embodiment according to the invention, the key 21 forms part of the socket 1 itself and not of a plate renders this socket particularly convenient to implant.

It should be noted on this subject that it is not necessary to provide a special plate for this socket 1. As shown in FIG. 3, this socket is fixed, thanks to upper

(25) and lower (26) transverse grooves provided in body 4 to that end, by clipping in any orifice of a plate 27 previously pierced to the dimensions. This plate may be of any type: sheet metal plate, front plate of a box, etc. . . . .

FIGS. 5 to 7 show in greater detail one of the flat self-stripping metal contacts 10 which are used on the socket 1 which has just been described with reference to FIGS. 1 to 4. However, it will be noted that the contacts 10 which are shown in FIG. 2 each comprise a lower notch, right- or left-hand depending on the case, which is cut out a posterior for a practical role of assembly and which has not been shown in FIGS. 5 to 7.

The conventional flat self-stripping metal contacts are made in one layer of metal material. They must therefore be provided to be of a certain width in order to ensure good mechanical strength, which is penalizing from the standpoint of compactness. Furthermore, for this type of flat self-stripping contact, there is always the problem of ensuring a sufficient force of retention of the wire in the contact when an effort directed parallel to the longitudinal axis of the self-stripping slot is exerted, after self-stripping connection of the wire.

The flat metal contact according to FIGS. 5 to 7, which comprises in this example two self-stripping slots 11A and 11B but which might equally well comprise only one, is composed of two superposed metal layers 40A and 40B which are simply made from a portion of single metal band 40 which is folded on itself on the small side 41 which is opposite the self-stripping slots 11A, 11B.

This presents the advantage of being able to reduce the width L of the contact 10 and thus to improve the compactness of the product, such as the socket 1 described hereinabove which uses it. In addition, a connection surface is thus available between the metal core of the wire and the contact which is at least equal to if not greater than the section of this metal core: this ensures a high force of retention of this wire in the contact when an effort directed parallel to the axis of the self-stripping slot is exerted.

However, although this double thickness 40A, 40B of metal material presents such undeniable advantages in contact resistance and strength of the wire, it increases, a priori in penalizing manner, the force necessary for insertion of the conductor in the connection slot 42A, 42B proper of the wire. In order to overcome this drawback, an impact is made on only one, 40B, of the two metal layers 40A, 40B, in the inlet zone 43 of the connection slot 42A proper of the wire. In this zone 43, the metal layer 40B is thus thinned, elongated in the direction of the inlet of the slot 11A or 11B, and provided with a chamfer in thickness 44 which gives it a finely bevelled leading edge 45. A good progressive stamping of the core of the conductor is thus obtained, which has for a consequence to reduce in substantial proportions the effort necessary for the connection. Nonetheless, certain rules must be respected: when the impact is made, it is followed by a cut-out which aims not only at forming an inlet chamfer 46 in "V" form for the connection slot 42A, but also aims at leaving intact an edge 45 whose thickness "x" is at the most equal to one third of the thickness "a" of the base material 40, i.e. to one third of the thickness of the layer 40B outside the zone 43.

It should be noted that this contact 10 comprises, in very conventional manner, a lug 47 for retention in the plastic body which receives it.

Finally, each connection slot 11A, 11B advantageously comprises two successive zones "a" and "b", each preferably provided with an inlet chamfer in "V" form, 47 and 48 respectively:

an inlet zone "a" of uniform width L1 which, having the role of pinching the sheath of the wire not yet stripped, is of a width L1 greater than the maximum diameter of the core of the wires to be connected and smaller than the narrowest of the sheathed wires to be connected; and a second, narrower, zone "b" which follows the zone "a", and which is conventionally the zone which is adapted to effect the self-stripping connection proper of the wire, as its width L2 is smaller than the minimum diameter of the metal core of the wires to be connected.

If zone "b" is effectively intended to effect the connection proper, the zone "a" serves during the operations preliminary to this connection: in order to facilitate the operations of connection, it is advantageous to allow the operator to present his wire opposite the contact and to arrange for it to be maintained in position. This first part "a" of the slot 11A or 11B then serves to pinch the wire before it is introduced in the self-stripping part "b" proper.

It goes without saying that the invention is not limited to the embodiment which has just been described: this modular jack female socket is, on the contrary, capable of being made in accordance with numerous variants possibly employing various equivalent means, and the self-stripping metal contact of FIGS. 5 to 7 may equally well equip products other than this female modular lack socket.

What is claimed is:

1. A female socket of the "modular jack" type, with integrated connections, wherein it comprises:

a hollow insulating body presenting a female opening at the front adapted to receive a complementary male "modular jack" plug, and an opening at the rear;

a solid insulating piece fitting tightly in the rear opening of the body, and provided with longitudinal notches around almost all of the piece and each receive an elastic conducting arm so as to form towards the front conventional elastic, parallel "modular jack" contacts located at a back of said female opening, the notches widening rearwardly on an upper face of the piece, arriving on a transverse rear face of the piece and serving as guides for free, elastic rear parts of the arms which form contact members and which are associated, by couples of contacts of different lengths, with a short contact, with a couple arriving substantially halfway up the rear face, and the other, long, descending much further down;

and two insulating half-caps which are positioned beneath each other to cover the rear part of the body and which each imprison a number of self-stripping contacts equal to half the number of pins of the modular jack socket, with the result that, when the half-caps are placed in position, the self-stripping contacts of the upper half-cap each rub respectively against one of said "short" contacts, whilst, in the same way, the self-stripping contacts of the lower half-cap then each rub respectively against one of said "long" contacts.

2. The female modular jack socket of claim 1, wherein at least certain of the self-stripping contacts are provided with two self-stripping slots instead of one, and therefore adapted each to receive two wires side by side.

3. The female modular jack socket of claim 1, wherein each of the half-caps comprises a cover adapted to close by rotating about a pin, the rotatable cover being shaped so as, whilst it is being rotated for closure, to drive into the self-stripping slots, the wires previously "combed" therein.

4. The socket of claim 1, wherein there is provided on lateral faces of said hollow body a longitudinal groove for passage of the two elastic arms of a conducting staple in the form of a recumbent U, the staple being fitted in the grooves so that a respective drain wire may be pinched therein, from the rear of the socket and on each side of said body.

5. The socket of claim 1, wherein it comprises a rotatable telephone-computer transfer key which is fast with the body.

6. The socket of claim 1, wherein its body is provided with two upper and lower transverse grooves which enable the body to be fixed by clipping in a receiving plate previously pierced to one end thereof.

7. A flat metal contact having at least one self-stripping slot, in particular for the socket of claim 1, wherein it is composed of two superposed metal layers, made from a single metal band folded on itself on a small side opposite the self-stripping slots, an inlet zone of a connection slot proper of the wire being thinned and bevelled on one of the two metal layers, typically by an impact made in the zone on one of the faces of the contact and therefore acting on one of the two superposed metal layers.

8. The self-stripping contact of claim 7, wherein the bevel which is made on the thinned part of said zone leaves intact, at its free end, an end edge whose thickness is at the most equal to one third of the thickness of the same metal layer outside said thinned part.

9. The self-stripping metal contact of claim 7, wherein each of its self-stripping slots comprises two successive zones with inlet chambers in "V" form:

an inlet zone of uniform width which, having the role of pinching the sheath of the wire not yet stripped, is of a width greater than the maximum diameter of the metal core of the wires to be connected and smaller than the diameter of the sheath of the narrowest of the sheathed wires to be connected; and a second, narrower, zone which follows the inlet zone and which is conventionally the zone which is adapted to effect the self-stripping connection proper of the wire to be connected, as its width is smaller than the minimum diameter of the core of the wires to be connected.

* * * * *